United States Patent [19]

Ausnit

[11] Patent Number: 4,601,154

[45] Date of Patent: Jul. 22, 1986

[54] AUTOMATIC PACKAGING UNIT FOR BAG MAKING MACHINE

[75] Inventor: Steven Ausnit, New York, N.Y.

[73] Assignee: Minigrip Inc., Orangeburg, N.Y.

[21] Appl. No.: 614,488

[22] Filed: May 29, 1984

[51] Int. Cl.[4] ..... B65B 63/04

[52] U.S. Cl. ..... 53/119; 53/430; 53/586; 53/202

[58] Field of Search ..... 53/399, 430, 447, 119, 53/202; 414/53; 271/85

[56] References Cited

U.S. PATENT DOCUMENTS

| | | | |
|---|---|---|---|
| 2,959,269 | 11/1960 | Kammerer | 198/447 |
| 3,199,653 | 8/1965 | McGowan | 271/85 |
| 3,410,423 | 11/1968 | Brockmuller | 414/53 X |
| 3,525,444 | 8/1970 | Brockmuller | 414/53 |
| 3,538,678 | 11/1970 | Lefort | 53/202 |
| 3,605,380 | 9/1971 | Dille | 53/202 |
| 3,672,265 | 6/1972 | Schwarzkopf | 414/53 X |
| 4,079,574 | 3/1978 | Monguzzi | 53/119 |

FOREIGN PATENT DOCUMENTS

| | | | |
|---|---|---|---|
| 2406746 | 8/1975 | Fed. Rep. of Germany | 53/119 |

*Primary Examiner*—John Sipos

*Attorney, Agent, or Firm*—Kane, Dalsimer, Kane, Sullivan and Kurucz

[57] ABSTRACT

A method and apparatus are provided for packaging bags wherein the bags are permitted to accumulate from the outlet of a bag making machine onto a slotted plate.

First and second sets of fingers grasp the bags that accumulate after a desired number of bags accumulate on the plate. The bags are transported to a bailing station where the stack of bags is rolled into a bundle, tied and knotted. The fingers travel between the bag making machine and the bailing station along non-intersecting paths of motion.

16 Claims, 12 Drawing Figures

FIG. 2
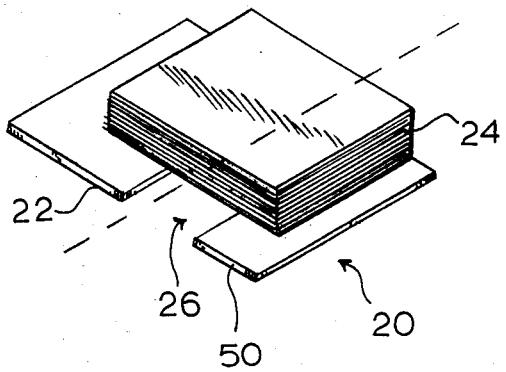
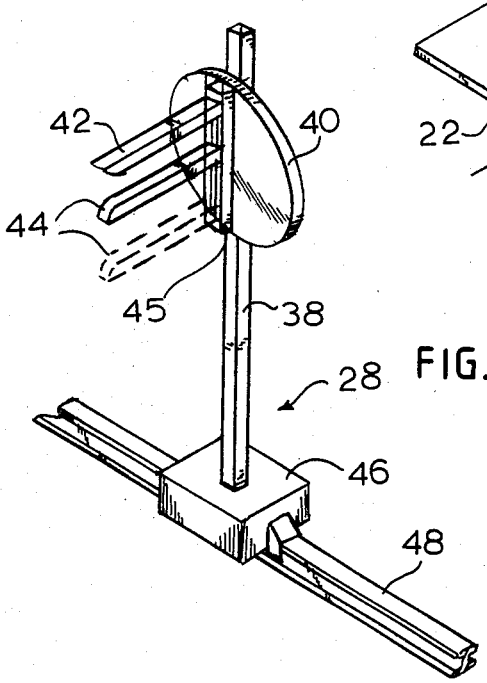
FIG. 3
FIG. 4
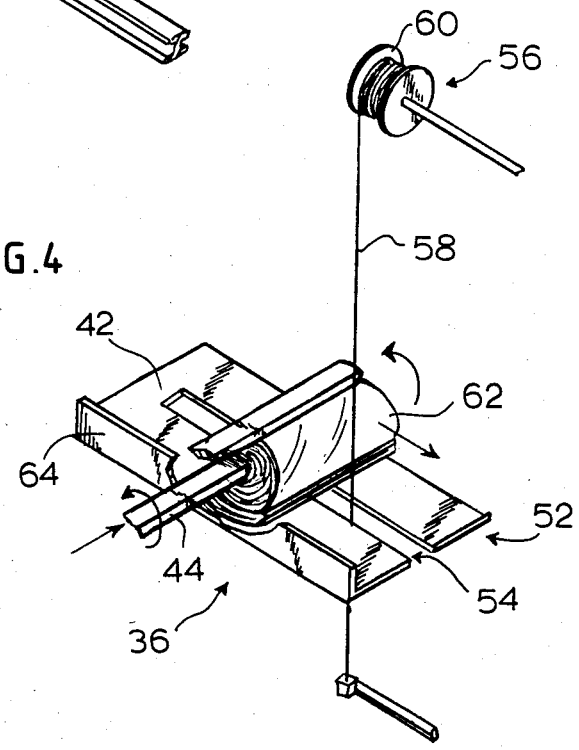

18
20a
20c
28
30
32
34
36a
36b 18
20a
20c
28
30
32
34
36a
36b 18
20a
20c
28
33
36a
36b 18
20a
20c
28
30
32
36a
36b 18
20a
20c
36a
36b

AUTOMATIC PACKAGING UNIT FOR BAG MAKING MACHINE

BACKGROUND OF THE INVENTION

The present invention relates to reclosable plastic bags and in particular to an improved method for rolling and bailing such bags for subsequent packaging.

Reclosable plastic bags for home and industrial applications are commonly formed on a bag making machine which serves to seal the side edges of a folded sheet of plastic film or of an extruded tube to form the desired bag. The finished bags are conveyed to a take-up section of the machine where an operator takes up a batch of counted bags and places them in a box or carton for final packaging either loose or in rolled bundles. The rolled bundle is particularly desireable for consumer bags since it facilitates removal of individual bags from the box.

Heretofore it has been commonplace to position an operator at the end of the bag machine to manually form the desired bundle when a desired number of bags have been accumulated. Attempts have been made to automate the take-off of finished reclosable bags and such attempts have had some limited success particularly where a bag making machine is dedicated to making one size bag only. However, since the speed of such automated equipment must necessarily be governed by the time required to form and accumulate the desired number of bags for each bundle, form the desired bundle, deliver the bundle to a carton and then return for the next take-up operation it is the slowest speed that governs the entire operation. This is generally that of the bag making equipment.

In view of the above, it is the principal object of the present invention to provide an improved automatic bag bundling machine which may operate at a sufficiently fast speed so as not to impede the bag making operation.

A further object is to provide such a machine which may be operated efficiently and brought into synchronization with virtually any speed of operation of an associated bag making machine.

A still further object is to provide such a machine in which the bags are bundled into rolls.

Still other objects and advantages will become apparent from a review of the following description of a preferred embodiment of the present invention.

SUMMARY OF THE INVENTION

The above and other beneficial objects and advantages are attained in accordance with the present invention by forming at least first and second stacks of bags at the outlet of a bag making machine resting respectively on first and second slotted plates. When a desired number of bags is accumulated on a plate the stack is grasped between a set of upper and lower fingers. First and second sets of fingers are provided respectively for the first and second slotted plates. The grasped stacks are delivered to a bailing station, rotated to form rolls, and the rolls are tied or taped. The fingers are then returned to the bag machine outlet to receive the next stack of bags accumulated. An important feature of the present invention resides in having the first and second sets of fingers travel between the bag machine outlet and the bailing station along non-intersecting paths so that the motion of one set of fingers will not interfere with that of the other set of fingers.

During each cycle the fingers may return to the same accumulating plate or to a different plate depending upon the time required for the bag machine to form and accumulate the desired number of bags on the slotted plate and the time required to form the rolled bundle and deliver the same to the bailing station.

BRIEF DESCRIPTION OF THE DRAWINGS

In the accompanying drawings:

FIG. 2 is a simplified perspective view of a bag accumulating plate designed for use in accordance with the present invention;

FIG. 3 is a simplified perspective view of the bag grasping fingers for use in accordance with the present invention;

FIG. 4 is a simplified perspective representation of the bag bailing section used in accordance with the present invention.

DETAILED DESCRIPTION OF THE PREFERRED EMBODIMENTS

Figure 1:
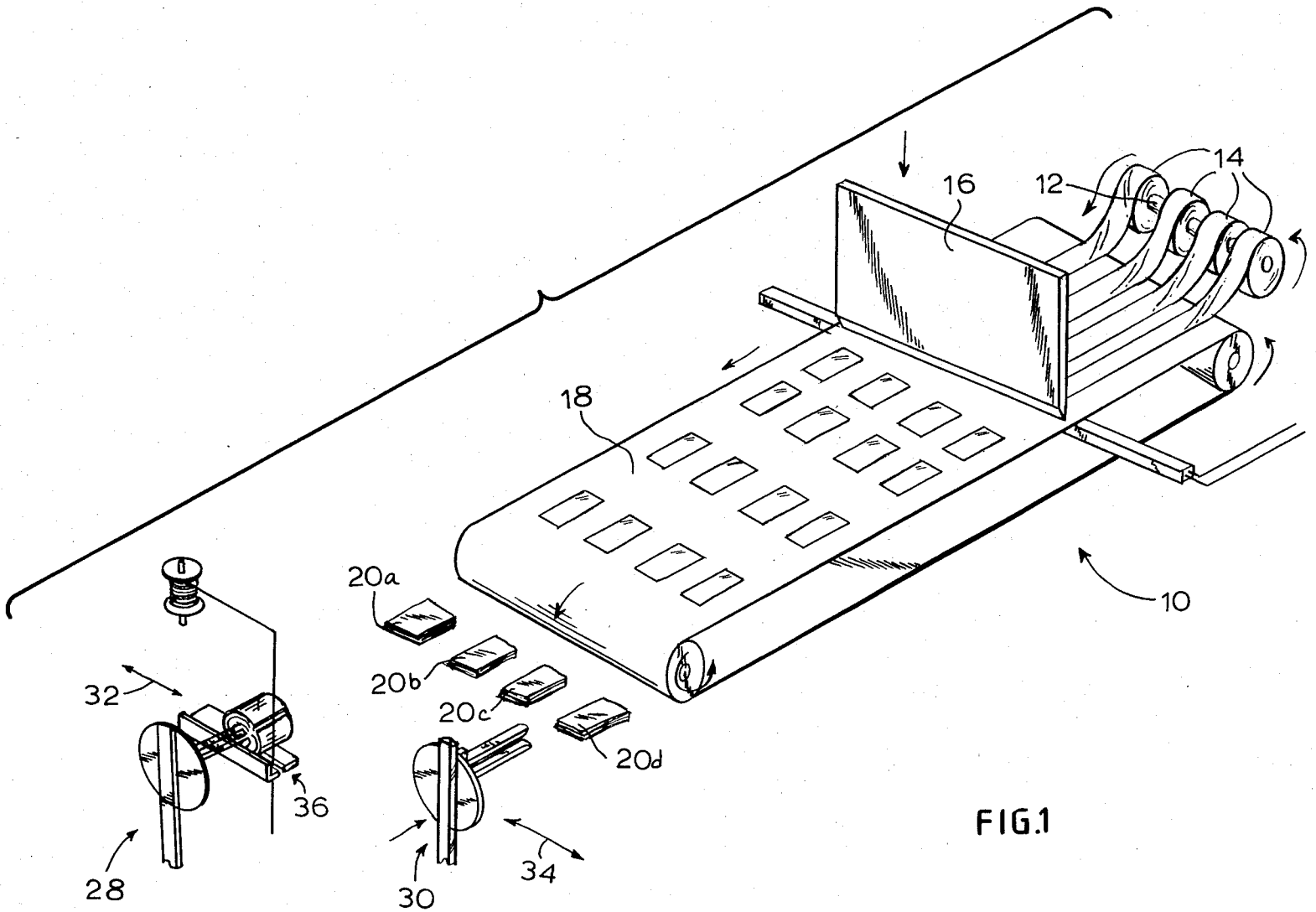
FIG. 1 is a schematic representation of the bag bundling method in accordance with the present invention.

Reference is now made to the drawings and to FIG. 1 in particular wherein a bag making machine 10 is shown comprising a frame 12 for supporting one or more rolls of flattened extruded plastic profile tubing 14 such as that produced in accordance with U.S. Pat. No. Re. 29,208 which is to be formed into reclosable bags. The tubing is fed past a heated knife 16 which serves to slice a tube transverse to its longitudinal axis and to simultaneously heat seal along the slice line to form the sides of a bag. Either before or after the sides are formed the tube is slit longitudinally between the profiles to form the bag opening. The thus formed bag is then carried along a conveyor belt 18 to an accumulating station 20. As shown, there is one accumulating station for each roll of tubing fed into the bag making machine.

Referring to FIG. 2, it can be seen that each accumulating station comprises a slotted plate 22 positioned below the conveyor 18 so that a stack of bags 24 accumulates on the plate as the bags move to the end of conveyor. The slot 26 of plate 22 extends toward the bag making machine and is offset from the center of the plate. The bags bundled in accordance with the present invention may be conventional flat bags as well as reclosable bags however, in the latter case, the bags are stacked so that the plate slot is offset toward the zipper profiles.

In accordance with the present invention two or more clamping finger mechanisms 28, 30 are provided for movement along separate paths 32, 34 that extend between the accumulating stations 20 and a bailing station 36. As shown in FIG. 3, clamping mechanism 28 (which is identical to mechanism 30) consists of a stand 38 to which a disc 40 is mounted for rotation. A pair of spaced fingers 42, 44 are provided on the disc 40 for movement toward and away from each other along track 45 which is mounted for rotation with disc 40. The stand 38 is mounted to a carriage 46 which moves along a rail 48 that defines the path 34. The actuation of fingers 42, 44 and the transport of carriage 46 may be effected by pneumatic lines (not shown). The length of fingers 42, 44 and the depth of slot 26 as well as the positioning of rail 48 with respect to the front edge 50 of plate 22 are such that fingers 42, 44 do not extend beyond the rear edge of slot 26.

The bailing station 36 is depicted in FIG. 4. Station 36 consists of a plate 52 positioned along track 48 and having a slot 54 which extends from the front toward the rear of the plate generally parallel to track 48. A conventional string tier 56 is positioned to feed string 58 from a roll 60 through slot 54 to tie about a bundle of bags positioned over the slot. The string tier operates in the same manner as similar machines commonly found in bakeries and like establishments.

In operation, clamping mechanism 28 with fingers 42, 44 separated is brought into vertical alignment with slot 26 of a first accumalating station plate when the desired number of bags have accumulated on the plate. The fingers are then activated to move toward the center of disc 40 to grasp the stacked bags therebetween and lift them off the plate. The carriage transport is then activated to move the clamping mechanism (along with the grasped bags) to bailing station 36 travelling along rail 48 which defines path 32. When the bags reach tier plate 52 disc 40 is rotated to roll the stack of bags against plate 52 thereby forming a rolled bundle 62 of bags. The fingers 42, 44 are then withdrawn after tier 56 is activated to wrap and knot a length of string about the bundle of bags. To this end, carriage 46 includes portions adapted to shift tranverse to rail 48 when activated. A flange 64 holds the rolled bundle 62 on plate 52 as fingers 42 and 44 are withdrawn thereby freeing the roll of bags from the fingers. The clamping mechanism is then free to travel back to the bag making machine to receive another stack of bags and repeat the process. The clamping mechanism might return to the same plate 20 (i.e. plate 20*a*) or to another plate (i.e. 20*b*, 20*c*, 20*d*) depending upon the relationship of the speed of the bag making machine relative to that of the bailing mechanism. As stated, clamping mechanism 30 operates in precisely the same fashion.

An important aspect of the present invention is that while clamping mechanism 28 is receiving a stack of bags from the bag making machine, clamping mechanism 30 is delivering a stack to the bailing station or vice versa. This permits the bag making machine to run at full capacity by enabling the clamping mechanisms 28, 30 to remove a stack of bags as soon as the required number of bags has accumulated. Accordingly, it is important that the paths of movement of the clamping mechanism 28 and 30 not interfere with each other as they travel between the bag making and bag bailing stations. In FIGS. 5 and 6 several alternate paths of motions are illustrated for different embodiments of the present invention. Thus, in FIG. 5(*a*) the paths 32 and 34 are parallel to each other. Clamping mechanism 28 serves a first accumulating station 20*a* (or a first group of stations) and clamping mechanism 30 serves a second accumulating station 20*c* (or a second group).

Figures 5A, 5B, 5C, 5D, 5E:
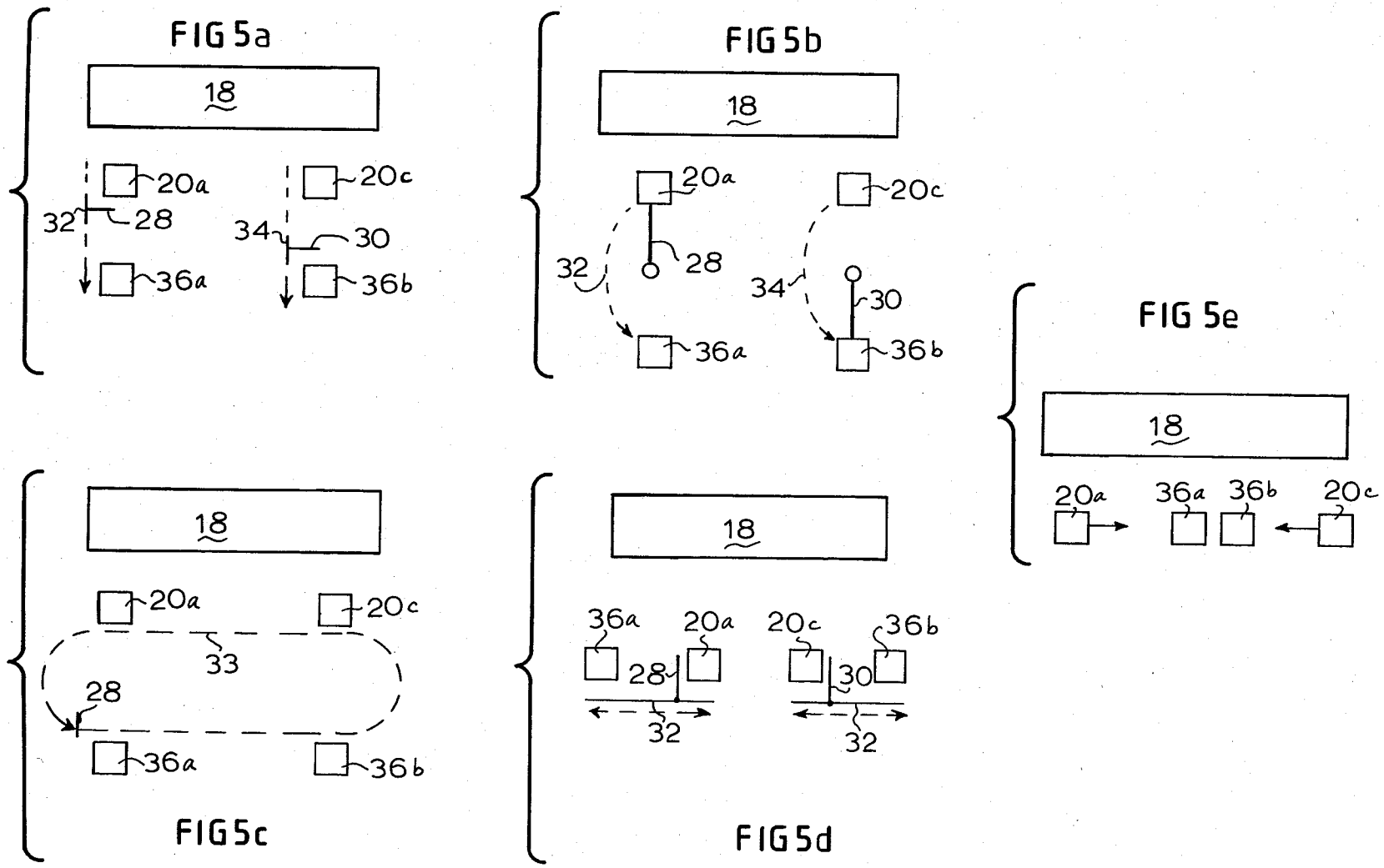
FIGS. 5*a*–5*e* are schematic top plan representations of the discharge end of the bag making machine showing alternative arrangements of the paths of travel of the bag bundle grasping fingers and the positioning of the bundle bailing station.

The embodiment of FIG. 5*b* is similar to that of FIG. 5*a* except that the clamping mechanisms 28 and 30 rotate along arcuate paths between the bag machine 18 and bailing stations 36.

In the embodiment of FIG. 5*c* a single track 33 extends in a loop past accumulating stations 20*a* and 20*c* as well as bailing stations 36*a* and 36*b*. The clamping mechanisms 28 and 30 travel along loop 33 offset from each other so that when one is delivering bags to the bailing station the other is picking up bags from the accumulator.

In the embodiment of FIG. 5*d* the bailing stations 36*a* and 36*b* are offset from the sides of the bag making machine 18 and the paths 32 and 34 are extensions of each other. FIG. 5*e* is similar to FIG. 5*d* except that the bailing stations 36*a* and 36*b* are on the inside and the accumulating stations 20 are on the outside.

Figure 6A:
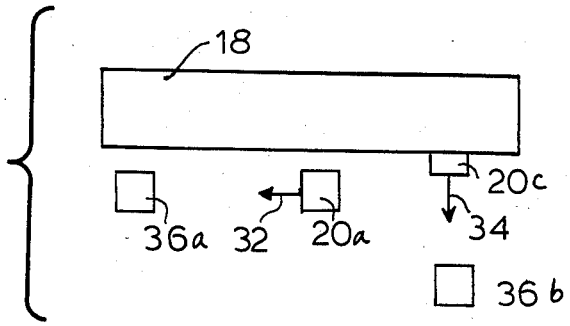
FIGS. 6*a* and 6*b* are schematic front elevational views similar to FIG. 5 showing still further alternative arrangements.
Figure 6B:
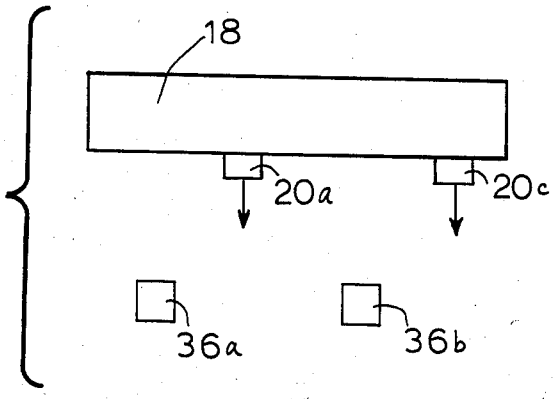

In FIG. 6*a* one bailing station 36*b* is positioned below the plane of the bag making machine conveyor. Thus, one path of motion 32 is horizontal while the other, 34, is vertical. In FIG. 6*b* both bailing stations 36*a* and 36*b* are positioned below their respective accumulating stations so that both paths of motion 32 and 34 are vertical and parallel to each other.

Figure 7:
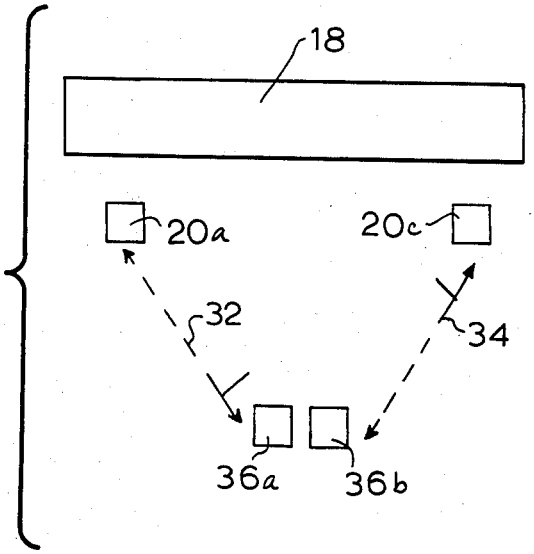
FIG. 7 is a schematic front elevational view similar to FIGS. 5 and 6 showing still another alternative arrangement.

In FIG. 7 the bailing stations 36*a* and 36*b* are offset both vertically and horizontally from the accumulating stations so that the clamping mechanisms travel along diagonal paths. While the bailing stations are shown below and inward of the accumulating stations, one or both of the bailing stations could have been located above and/or outward of its associated accumulating station.

In each case the clamping mechanisms are able to remove bags from the bag making machine at a speed determined by the bag making speed. Hence, no slow down of the bag making operation is necessitated by the use of the present invention.

Thus, in accordance with the above the aforementioned objectives are effectively attained.

Having thus described the invention, what is claimed is:

1. An apparatus for forming secured bundles of bags comprising:

means for accumulating first and second stacks of a predetermined number of bags on first and second slotted plates;

first and second pairs of spaced fingers for respectively grasping said first and second stacks and for lifting said stacks off said slotted plates each said pair being rotatable;

at least one station comprising a support plate for one of said stacks and cooperating with said pairs of fingers for forming said stacks into bundles, means for rotating said first and second pairs of fingers to roll said one of said one first and second stacks against said support plate while said one stack is at said station to form said bundle; and means for moving said first pair of fingers back and forth between said first slotted plate and said station along a first path and for moving said second pair of fingers back and forth between said second slotted plate and said station along a second path, said first and second paths being non-intersecting.

2. The invention in accordance with claim 1 wherein said station includes means for tying a rolled stack of bags.

3. The invention in accordance with claim 1 wherein said means for moving said first and second sets of fingers are out of synchronization with each other.

4. The invention in accordance with claim 1 wherein said first and second paths are parallel to each other.

5. The invention in accordance with claim 4 wherein at least one of said first and second paths extend generally horizontally.

6. The invention in accordance with claim 5 wherein at least one of said first and second paths extend generally vertically.

7. The invention in accordance with claim 1 wherein said first and second paths are vertically offset from each other.

8. The invention in accordance with claim 1 wherein said station is interposed between said first and second slotted plates.

9. The invention in accordance with claim 1 wherein two stations are provided and said slotted plates are interposed between said stations.

10. The invention in accordance with claim 1 wherein said first and second paths define a continuous loop.

11. The invention in accordance with claim 1 wherein at least one of said first and second paths is on a diagonal.

12. The invention in accordance with claim 1 wherein at least one of said first and second paths is arcuate.

13. The invention in accordance with claim 1 wherein one of said first and second paths extends horizontally and the other of said paths extends vertically.

14. The invention in accordance with claim 5 wherein both of said paths extend horizontally.

15. The invention in accordance with claim 6 wherein both of said paths extend vertically.

16. The invention in accordance with claim 1 wherein said means for accumulating first and second stacks includes first and second horizontal plates for supporting said stacks, each plate having a slot arranged and positioned to permit one of said pairs of fingers to engage and remove the corresponding stack.

* * * * *